US007901205B2

(12) United States Patent
Trochou

(10) Patent No.: US 7,901,205 B2
(45) Date of Patent: Mar. 8, 2011

(54) GAS BURNER WITH MULTIPLE CONCENTRIC FLAME RINGS

(75) Inventor: Christophe Trochou, Veigne (FR)

(73) Assignee: Burner Systems International (BSI), Veigne (FR)

( * ) Notice: Subject to any disclaimer, the term of this patent is extended or adjusted under 35 U.S.C. 154(b) by 60 days.

(21) Appl. No.: 11/997,265

(22) PCT Filed: Jul. 27, 2006

(86) PCT No.: PCT/FR2006/001844

§ 371 (c)(1),
(2), (4) Date: Jan. 29, 2008

(87) PCT Pub. No.: WO2007/012766

PCT Pub. Date: Feb. 1, 2007

(65) Prior Publication Data

US 2008/0206697 A1 Aug. 28, 2008

(30) Foreign Application Priority Data

Jul. 29, 2005 (FR) ..... 05 08166

(51) Int. Cl.
*F23D 14/06* (2006.01)
*F23D 14/62* (2006.01)

(52) U.S. Cl. ..... 431/284; 431/278; 431/285; 431/286; 431/354; 126/39 E; 126/39 R

(58) Field of Classification Search ..... 126/39 E, 126/39 R; 431/278, 283, 285, 286, 354, 431/284

See application file for complete search history.

(56) References Cited

U.S. PATENT DOCUMENTS

| | | | | | |
|---|---|---|---|---|---|
| 1,130,132 | A | * | 3/1915 | Antonuccio | 126/39 R |
| 1,539,420 | A | * | 5/1925 | Kerr | 239/543 |
| 1,850,866 | A | * | 3/1932 | Conover | 431/280 |
| 1,862,849 | A | * | 6/1932 | Frame | 431/285 |
| 2,391,593 | A | * | 12/1945 | Porter | 431/350 |
| 2,640,531 | A | * | 6/1953 | Lamar | 431/284 |
| 3,802,827 | A | * | 4/1974 | Semenov et al. | 431/8 |
| 3,825,404 | A | * | 7/1974 | De Gouville | 431/354 |
| 4,773,383 | A | * | 9/1988 | Le Monnier de Gouville et al. | 126/39 R |
| 4,953,534 | A | * | 9/1990 | De Gouville et al. | 126/39 H |
| 5,002,038 | A | * | 3/1991 | Riehl | 126/39 R |
| 5,083,915 | A | * | 1/1992 | Riehl | 431/264 |

(Continued)

FOREIGN PATENT DOCUMENTS

EP 485645 A1 * 5/1992

(Continued)

*Primary Examiner* — Carl D. Price
*Assistant Examiner* — Daniel E Namay
(74) *Attorney, Agent, or Firm* — Jennifer E. Lacroix, Esq.; DLA Piper LLP (US)

(57) ABSTRACT

The invention concerns a gas burner (1) with multiple concentric flame rings, comprising: a central burner (2) with a central ring of flame orifices (5), and axial central gas injector (6) and convergent-divergent means (7) forming venturi; and an annular outer burner (3) coaxially surrounding the central burner and provided with at least one annular ring of flame orifices (9), gas injecting means (10) and convergent-divergent means (12) forming venturis; the gas injecting means (10) include several radial gas injectors (11) around the central injector (6); the convergent-divergent means (12) include several radial convergent-divergent conduits (13) forming tubular venturis coaxial respectively to the radial injectors (11) and emerging in the annular outer burner.

2 Claims, 4 Drawing Sheets

U.S. PATENT DOCUMENTS

| | | | | | |
|---|---|---|---|---|---|
| 5,085,202 | A * | 2/1992 | Riehl | 126/39 R |
| 5,125,390 | A * | 6/1992 | Riehl | 126/39 R |
| 5,133,334 | A * | 7/1992 | Riehl | 126/39 R |
| 5,149,262 | A * | 9/1992 | Riehl | 431/258 |
| 5,266,026 | A * | 11/1993 | Riehl | 431/264 |
| 5,277,576 | A * | 1/1994 | Hartung et al. | 431/198 |
| 5,328,357 | A * | 7/1994 | Riehl | 431/266 |
| 5,401,164 | A * | 3/1995 | Yen | 431/354 |
| 5,636,980 | A * | 6/1997 | Young et al. | 431/202 |
| 5,842,849 | A * | 12/1998 | Huang | 431/284 |
| 6,030,207 | A * | 2/2000 | Saleri | 431/354 |
| 6,132,205 | A * | 10/2000 | Harneit | 431/354 |
| 6,263,868 | B1 * | 7/2001 | Koch et al. | 126/39 R |
| 6,299,436 | B1 * | 10/2001 | Huang | 431/354 |
| 6,325,619 | B2 * | 12/2001 | Dane | 431/284 |
| 6,332,460 | B1 * | 12/2001 | Paesani | 126/39 R |
| 6,537,065 | B1 * | 3/2003 | Shirali et al. | 431/354 |
| 6,780,008 | B2 * | 8/2004 | Koch et al. | 431/354 |
| 6,851,420 | B2 * | 2/2005 | Jennings | 126/39 R |
| 6,889,685 | B2 * | 5/2005 | Dane | 126/39 B |
| 7,001,176 | B2 * | 2/2006 | Bettinzoli | 431/354 |
| 7,594,812 | B2 * | 9/2009 | Armanni | 431/283 |
| 7,661,954 | B2 * | 2/2010 | Harneit | 431/278 |
| 2001/0010897 | A1 * | 8/2001 | Dane | 431/266 |
| 2002/0172906 | A1 * | 11/2002 | Koch | 431/354 |
| 2003/0039935 | A1 * | 2/2003 | Harneit | 431/266 |
| 2003/0075164 | A1 * | 4/2003 | Dane | 126/39 R |
| 2003/0087214 | A1 * | 5/2003 | Welton et al. | 431/286 |
| 2004/0072112 | A1 * | 4/2004 | Harneit | 431/266 |
| 2004/0234915 | A1 * | 11/2004 | Koch et al. | 431/278 |
| 2005/0250065 | A1 * | 11/2005 | Carbone et al. | 431/354 |
| 2006/0024632 | A1 * | 2/2006 | Sanchez | 431/354 |
| 2007/0141521 | A1 * | 6/2007 | Armanni | 431/354 |
| 2008/0090192 | A1 * | 4/2008 | Dane et al. | 431/354 |
| 2008/0145809 | A1 * | 6/2008 | Starnini et al. | 431/354 |
| 2008/0206697 | A1 * | 8/2008 | Trochou | 431/284 |
| 2009/0047611 | A1 * | 2/2009 | Armanni | 431/284 |

FOREIGN PATENT DOCUMENTS

| | | | |
|---|---|---|---|
| EP | 552135 | A2 * | 7/1993 |
| EP | 1180642 | A1 * | 2/2002 |
| EP | 1531304 | A2 * | 5/2005 |
| GB | 2233444 | A * | 1/1991 |
| WO | WO 9908046 | A1 * | 2/1999 |
| WO | WO2004/044490 | A1 | 5/2004 |
| WO | WO 2004044490 | A1 * | 5/2004 |
| WO | WO2005/078342 | A1 | 8/2005 |
| WO | WO 2005078342 | A1 * | 8/2005 |

* cited by examiner

GAS BURNER WITH MULTIPLE CONCENTRIC FLAME RINGS

FIELD OF THE INVENTION

The present invention relates to the field of gas burners with multiple concentric flame rings, and it relates more specifically to improvements to those of these burners that comprise:

- a central burner with a central ring of flame orifices, an axial central gas injector for said central burner, and convergent-divergent means forming venturi interposed between the central injector and the central ring of flame orifices, and
- an annular outer burner coaxially surrounding said central burner and provided with at least one annular ring of flame orifices, gas injecting means for the annular outer burner, and convergent-divergent means forming venturi interposed between the gas injecting means and the annular ring of flame orifices, and
- means for supplying gas to said axial central injector and to said injecting means.

BACKGROUND OF THE INVENTION

Gas burners of the type considered are already known, in particular from document PCT/FR04/00158 in the name of the Applicant.

These known burners have the disadvantage that the annular burner is supplied with an air-gas mixture in a single location of its periphery, so that it does not operate to its optimum.

SUMMARY OF THE INVENTION

The object of the invention is to provide a gas burner of this type that is more efficient from the energy point of view, namely more powerful with substantially identical dimensions, while being structurally simple and easy to manufacture and assemble.

To these ends, a gas burner with multiple concentric flame rings such as mentioned in the preamble is characterized, being arranged according to the invention,

- in that said gas injecting means for the annular outer burner comprise several gas injectors positioned substantially radially around the axial central gas injector, and
- in that the convergent-divergent means comprise at least two substantially radial convergent-divergent conduits forming tubular venturis with respective substantially radial spans and emerging in the annular outer burner, said conduits extending substantially coaxially respectively to said radial injectors.

By virtue of this arrangement, it is possible to supply a large air-gas mixture flow to the annular burner distributed in several locations of its periphery, so that its operation is optimized as compared with the former arrangement.

Such an arrangement allows complete freedom of choice as to the method of supplying gas. A first possibility of an assembly consists in that said means for supplying gas comprise a single tube situated centrally and connected to all the injectors. The burner is then provided with a single gas supply having a single control (single tap) simultaneously supplying the central burner and the annular outer burner. However, provision can also be made for said gas supply means to comprise a first tube connected to the axial central gas injector and a second tube connected to the lateral gas injectors. Each central burner and annular outer burner has its own gas supply with its own control (two respective taps) so that it is possible to achieve different heating at the center and at the periphery (WOK cooking).

In a preferred embodiment, the burner has a central base positioned coaxially to the central burner and this base comprises

- a substantially coaxial central bore emerging upward and able to receive said axial central gas injector, and
- at least two substantially radial lateral bores emerging laterally while being able to receive respectively the at least two lateral gas injectors positioned substantially radially.

It is then possible to arrange the base according to the type of gas supply selected. In the case of a common supply to the two central and annular outer burners, provision is made for the at least two substantially radial lateral bores of the base to communicate with the central bore and for the base to include additionally a connecting bore communicating with the lower end of the central bore and adapted for receiving the end of a gas supply tube. In the case of two distinct supplies, provision is made for the base to have a first connecting bore communicating with the central bore and adapted for receiving the end of a first gas supply tube and a second connecting bore communicating with said lateral bores and adapted for receiving the end of a second gas supply tube.

In order to preserve a sufficiently flat general configuration for the burner, it is desirable that the convergent-divergent tubular conduits forming venturis are inclined upward in an outward direction.

In this case, it is advantageous for the base to have, at least in its upper part, a substantially truncated conical general shape with a conicity such that the lateral gas injectors are inclined while being substantially coaxial respectively with the convergent-divergent conduits forming tubular venturis.

It is desirable, in order to obtain regular operation, for the convergent-divergent conduits forming tubular venturis to be angularly distributed in a substantially equidistant manner. Advantageously, these convergent-divergent conduits forming tubular venturis are between two and five in number, and preferably in practice three in number mutually separated angularly by approximately 120°.

In a concrete embodiment, the annular outer burner has two annular rings of flame orifices, inner and outer respectively.

Also in a concrete manner, the convergent-divergent means forming venturis interposed between the central injector and the central ring of flame orifices comprise a radial annular divergent component surrounding a central well coaxial with the central injector, so that, in conjunction with the tubular convergent-divergent conduits with a radial span for supplying the annular outer burner, it is possible to produce a gas burner with multiple concentric flame rings that is relatively shallow.

Typically, a gas burner arranged as has just been described may have a power of the order of 7 kW, while keeping approximately the transverse dimensions of a current burner with a power of the order of 5 kW.

Another valuable feature of the burner arranged according to the invention lies in the possibility of preserving a structural formation similar to that of former burners with a reduced number of constituent parts, such a burner comprising:

- a lower constituent part or pot adapted for being fixed to an upper plate of a cooking appliance substantially coaxial to an opening of said upper plate,
- an upper constituent part or head comprising a central part delimited peripherally by a curved lateral wall defining flame openings so as to constitute said central flame ring and an annular part substantially coaxial with said central part and delimited by at least one curved lateral wall defining flame openings so as to constitute said annular flame ring, a central cap with a substantially discoid shape adapted for covering said central part, and an annular cap adapted for covering said annular part.

In this case, the burner arranged according to the invention is characterized in that the pot has a central area arranged so as to support the axial injector and the radial injectors centrally, and at least the pot and/or the head have/has at least two radiating gutters that extend from said central area or respectively said central part where they emerge and as far as the outer edge of the pot or respectively as far as the annular part with which they communicate, said gutters being closed by the head or pot respectively in the assembly position of said pot and head so as to constitute said convergent-divergent conduits forming tubular venturis with a substantially radial span.

In this case, according to a preferred embodiment, provision is made for:

the pot to have at least two radiating gutters that extend from said central area and that are open respectively upward, the head to have at least two radiating gutters that extend from said central part and that are open respectively downward, and the gutters of the pot and the gutters of the head are superimposed pairwise, in the assembly position of said pot and head, so as to constitute said convergent-divergent conduits forming tubular venturis with a substantially radial span.

The design of the pot may, for its part, give rise to two possible embodiments according to the general design of the cooking appliance.

A first design consists in that the pot has a solid structure and in that at least the pot and/or the head have/has at least two substantially radial grooves, interposed between said gutters, which that extend while emerging between said central area and the outer edge of the pot or head respectively, these grooves being closed by the head or pot respectively in the assembly position of said pot and head in order to constitute passages with a generally radial span adapted for ensuring the supply of primary air from above the upper plate of the cooking appliance. In this case, it is advantageous to provide that:

the pot has at least two substantially radial grooves, that are interposed between said gutters and that open substantially upward, the head has at least two substantially radial grooves, that are interposed between said gutters and that open substantially downward, the grooves of the pot and the grooves of the head are superimposed pairwise in the assembly position of said pot and head, so as to constitute said passages for supplying primary air.

Another design consists in that the pot possesses a structure that is perforated at least partially between the gutters and that is adapted for ensuring the supply of primary air from below the upper plate of the cooking appliance.

Advantageously in this case, the gutters of the pot extend as far as below the annular part of the head and the annular part of the head possesses a bottom that is provided with openings facing the ends situated radially toward the outside of said gutters of the pot.

In the case where the injectors are supported on a common base as indicated above, it is of value for the central area of the pot to have a central opening through which said base supporting the injectors is engaged from underneath the pot, with its upper truncated conical part projecting above said central area and with its lower part subjacent to the pot, said lower part being provided with the connecting bore or bores.

In order to facilitate mutual guiding of the pot and head when assembled, and also to ensure their mutual locking in rotation once assembled, provision is advantageously made for the pot and/or the head to have pairs of projecting fingers positioned either side of the respective gutters and adapted for receiving the corresponding gutters of the head and/or the pot respectively.

In the preferred concrete arrangement mentioned above, provision is made for the pot and/or the head to have three substantially radial gutters mutually separated angularly by approximately 120° and three substantially radial grooves interposed between said gutters.

BRIEF DESCRIPTION OF THE DRAWINGS

The invention will be better understood on reading the following detailed description of some preferred embodiments given solely by way of non-limiting examples. In this description, reference is made to the appended drawings in which:

FIGS. 6A, 68 and 6C illustrate a second embodiment of the part of the burner shown in FIG. 3, respectively viewed from above and viewed in section along the lines B-B and C-C of FIG. 6A.

DETAILED DESCRIPTION OF THE INVENTION

Figure 1:
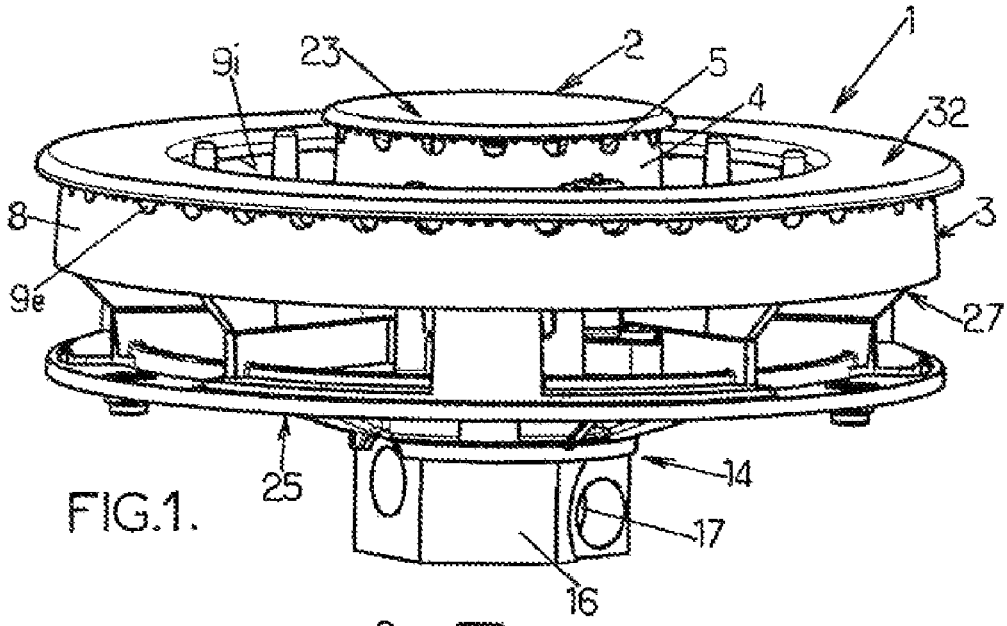
FIG. 1 is an overall view in perspective from the side of a possible embodiment of a gas burner with multiple flame rings arranged according to the invention.
Figure 3:
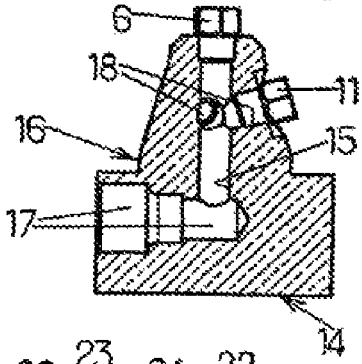
FIG. 3 is a sectional view of a first embodiment of a part of the burner of FIGS. 1 and 2.
Figure 2:
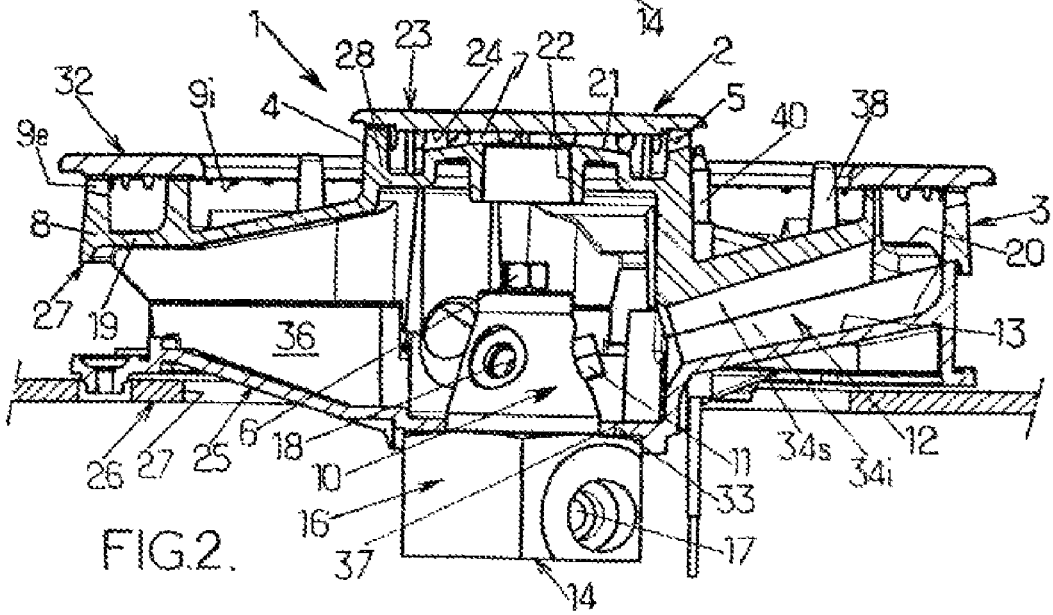
FIG. 2 is a view in diametral section of the burner of FIG. 1.

Referring first of all to FIGS. 1 to 3, a gas burner with multiple concentric flame rings, denoted in its entirety by the reference 1, that is the subject of the invention substantially comprises two elementary gas burners nesting one in the other, namely a central burner 2 and an annular outer burner 3 surrounding said central burner 2 coaxially.

The central burner 2 comprises:

a central burner body 4 possessing a central ring of flame orifices 5, a central axial gas injector 6 positioned substantially coaxially to said central burner body 4, and convergent-divergent means 7 forming venturi that are interposed between the central injector 6 and the central ring of flame orifices 5.

The annular outer burner 3 coaxially surrounding said central burner 2 comprises:

an annular outer burner body 8 having at least one inner and/or outer annular ring of flame orifices 9 (in FIGS. 1 to 5, two flame rings are provided, an inner one 9*i* and an outer one 9*e* respectively), gas injecting means 10 that comprise several gas injectors 11 positioned radially around the central axial gas injector 6, and convergent-divergent means 12 forming venturi interposed between the gas injecting means 10 and the annular ring of flame orifices 9, the convergent-divergent means 12 comprising at least two substantially radial convergent-divergent conduits 13 forming tubular venturis with a substantially radial span and emerging in the annular outer burner body 8, said convergent-divergent conduits 13 extending substantially coaxially with respect to said radial injectors 11.

Finally, the burner 1 has means 14 for supplying gas to said central axial injector 6 and to said injecting means 10, means 14 for supplying gas that will now be dealt with more explicitly.

The arrangement that has just been described leaves complete freedom of choice as to the method of supplying gas. A first assembly possibility consists of said gas supply means comprising a single tube situated substantially centrally and connected to all the injectors. The burner is then provided with a single gas supply having a single control (single tap) simultaneously supplying the central burner and the annular outer burner. However, provision may also be made for said means for supplying gas to have a first tube connected to the central axial gas injector and a second tube connected to the lateral gas injectors. Both the central burner and the annular outer burner have their own gas supply with its own control (two respective taps) so that it is possible to perform different heating at the center and the periphery (WOK cooking).

In this context, in order, at the same time, to simplify the structure of the burner and the assembly of its constituent parts, it is of value for the means 14 for supplying gas to have a central base 16 positioned coaxially to the central burner 2 and arranged so as to support all the gas injectors in their appropriate respective locations. To this end, provision is made for this base 14 to have, as may be seen in FIG. 3 and in FIGS. 6A to 6C:

a substantially coaxial central bore 15 emerging upward and adapted for receiving said central axial gas injector 6, and at least two substantially radial lateral bores 18 emerging laterally while being adapted for receiving respectively the at least two lateral gas injectors 11 positioned substantially radially.

It is then possible to arrange the base 16 according to the type of gas supply selected. In the case of a common supply for the central burner 2 and the annular outer burner 3, provision is made, as shown in FIG. 3, for all the substantially radial lateral bores 18 to communicate with the central bore 15 and for the base 16 to have additionally a connecting bore 17 communicating with the lower end of the central bore 15 and adapted for receiving the end of a gas supply tube (not shown). The central burner 2 and annular outer burner 3 are then controlled simultaneously from a single tap (not shown). Another possibility of an arrangement of the base 16 will be described hereinafter with regard to FIGS. 6A to 6C.

It should be emphasized here that the base 16 is shown in FIG. 3 in two sectional planes offset angularly so that its upper part is sectioned in the axis of a lateral bore 18 and its lower part is sectioned in the axis of the bore 17 for connecting a gas supply tube. In addition, in FIG. 2, a single injector 11 is shown in position on the base 16, while the other injector is not mounted and allows the corresponding bore 18 to be seen.

In order to lead the air-gas mixture to the annular outer burner 8 that is situated substantially above the radial injectors 11, it is desirable to avoid elbowed paths in order to reduce pressure losses. Under these conditions, provision may advantageously be made for the convergent-divergent conduits 13 forming tubular venturis to be inclined upward in an outward direction as may be seen in FIG. 2. Each conduit 13 is then substantially rectilinear. In this context, the design of the burner may be simplified by providing for the base 16 to have, at least in its upper part, a substantially truncated conical general shape with a conicity such that the lateral gas injectors 11 are inclined while being substantially coaxial respectively to the convergent-divergent conduits 13 forming tubular venturis.

In addition, as will be better seen in FIG. 2, the convergent-divergent conduits 13 reach under the annular burner body 8, which possesses a bottom 19 that is provided with openings 20 in correspondence with the ends of the conduits for the passage of the air/gas mixture.

In order to obtain a uniform supply of all the annular outer burner 3, it is desirable for the convergent-divergent conduits 13 forming tubular venturis to be angularly distributed in a substantially equidistant manner. In practice, the burner is easily designed and manufactured when the convergent-divergent conduits 13 forming tubular venturis are between two and five in number. A useful compromise consists of having the convergent-divergent conduits 13 three in number, mutually separated angularly by approximately 120°, as illustrated in the figures.

By virtue of the configuration adopted according to the invention, the annular outer burner 3 and the central burner 2 still function substantially independently of each other, since each of them has its own means for supplying an air-gas mixture. On account of this, the central burner 2 may be arranged in any desirable manner that is suitable for requirements. In particular, with a desire to design a shallow burner 1, it is advantageous for the convergent-divergent means 7 forming venturis interposed between the central injector 6 and the central flame ring 5 to include a radial annular divergent component defined by a plate 21 inclined downward in an outward direction and surrounding a central well 22 coaxial with the central injector 6 and by a face 24 opposite a cap 23 covering the central burner body 4, as may be seen in FIG. 2.

It is desirable for the burner according to the invention to retain a simple structure while being made of a minimum number of component parts. From this point of view, it is valuable for it to be made in a similar manner to the burner described in document PCT/FR04/00158 already mentioned. To this end, provision is made for the burner described above to comprise, as may be better seen in FIGS. 3, 4 and 5:

a lower constituent part or pot 25 adapted for being fixed to an upper plate 26 of a cooking appliance substantially coaxial to an opening 27 provided in said upper plate 26;

an upper constituent part or head 27 comprising:

a central part forming said central burner body 4, delimited peripherally by a lateral wall 28 curved in 29, so as to define, in conjunction with said central cap 23, flame openings constituting together the abovementioned central flame ring 5, and an annular part substantially coaxial with said central part and forming said annular outer burner body 8, this annular part being delimited by at least one lateral wall 30 curved in 31, defining, in conjunction with an annular cap 32, flame openings constituting together said annular flame ring 9 (in the example illustrated, the annular part is delimited by two lateral walls, an inner one 30*i* and an outer one 30*e* respectively, curved in 31*i* and 31*e* respectively, defining, in conjunction with the annular cap 32, flame openings constituting respectively the two annular flame rings 9*i* and 9*e;* said central cap 23 with a substantially discoid shape adapted for covering said central part, and said annular cap 32 adapted for covering said annular part.

In accordance with the arrangement according to the invention, provision is made as follows:

for the pot 25 to have a central area 33 arranged so as to support the axial injector 6 and the radial injectors 11 centrally, and for at least the pot 25 and/or the head 27 to have at least two radiating gutters 34 that extend from said central area 33 or respectively said central part forming the central burner body 4 where they emerge and as far as the outer edge of the pot 25 or respectively as far as the annular part forming the annular burner body 8 with which they communicate, said gutters 34 being closed by the head 27 or pot 25 respectively in the assembly position of said pot and head so as to constitute said convergent-divergent conduits 13 forming tubular venturis with a substantially radial span.

A simple way to implement the provisions that have just been described consists in that:

the pot 25 has at least two radiating gutters 34*i* that extend from said central area 33 and that are open respectively upward, the head 27 has at least two radiating gutters 34*s* that extend from said central part 4 and that are open respectively downward, and the gutters 34*i* of the pot and the gutters 34*s* of the head are superimposed pairwise, in the assembly position of said pot and head, so as to constitute said convergent-divergent conduits 13 forming tubular venturis with a substantially radial span.

In this context, it is conceivable for the pot to be designed according to two possible embodiments leading to two different respective operating modes of the burner according to the design of the cooking appliance.

A first embodiment consists, as shown in FIGS. 1, 2, 4 and 5, in that the pot possesses a solid structure and in that:

at least the pot 25 and/or the head 27 have/has at least two substantially radial grooves 35, interposed between said gutters 34, that extend while emerging between said central area 33 and the outer edge of the pot 25 or of the head 27 respectively, these grooves 35 being closed by the head 27 or the pot 25 respectively in the assembly position of said pot and head so as to constitute passages 36 with a generally radial span adapted for supplying primary air from above the upper plate 26 of the cooking appliance.

A burner is thus formed wherein the primary air necessary for the functioning of the two burners, a central one 2 and an annular outer one 3 respectively, is supplied from above the upper plate of the cooking appliance.

In the specific preferred arrangement shown in FIGS. 1, 2, 4 and 5, the following layouts are used:

the pot 25 has at least two substantially radial grooves 35*i*, that are interposed between said gutters 34*i* and that open substantially upward, the head 27 has at least two substantially radial grooves 35*s* that are interposed between said gutters 34*s* and that open substantially downward, and the grooves 35*i* of the pot and the grooves 35*s* of the head are superimposed pairwise in the assembly position of said pot and head, so as to constitute said passages 36 for supplying primary air.

Figure 4:
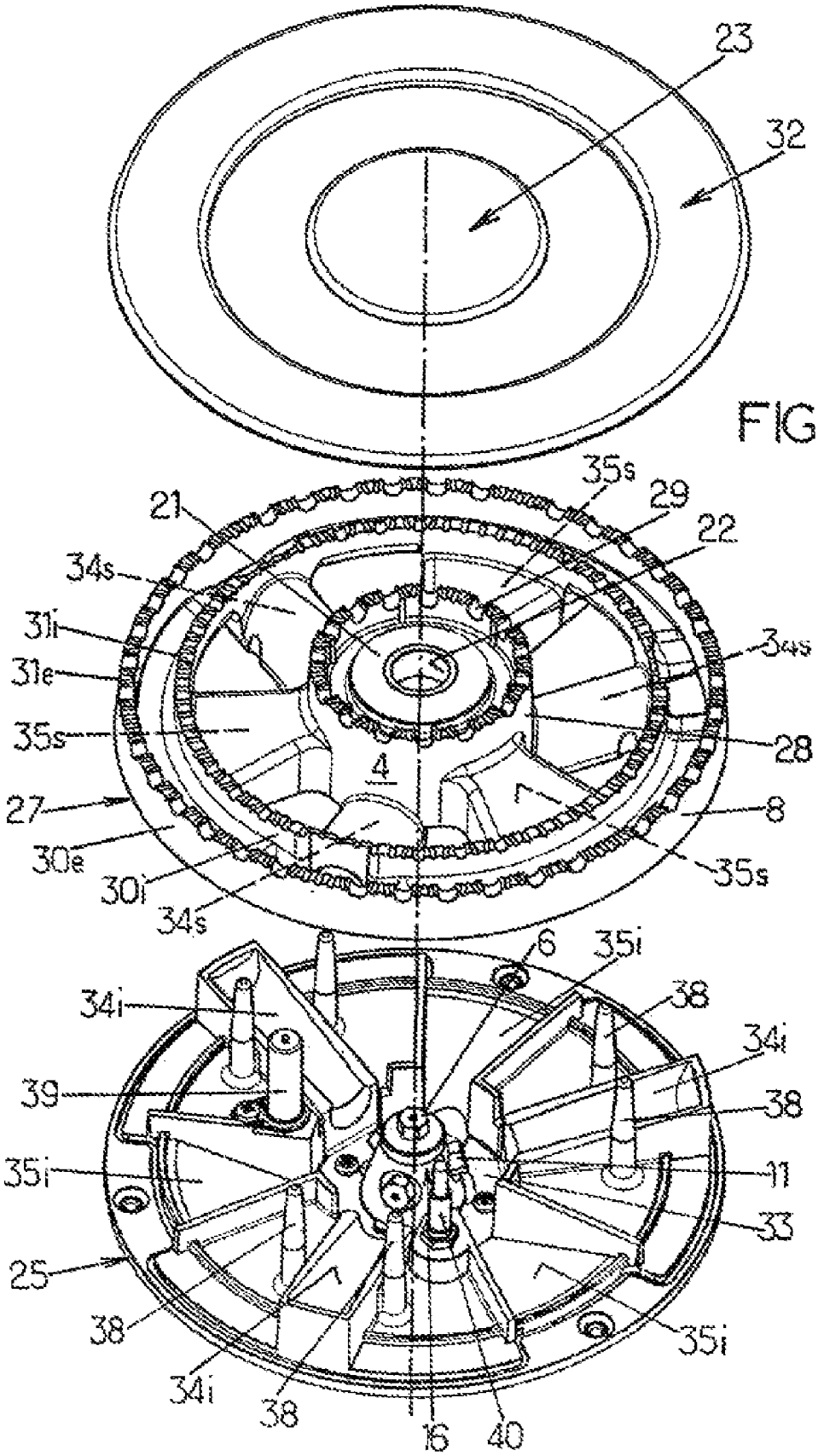
FIG. 4 is an exploded view in perspective from above of the burner of FIGS. 1 and 2.
Figure 7:
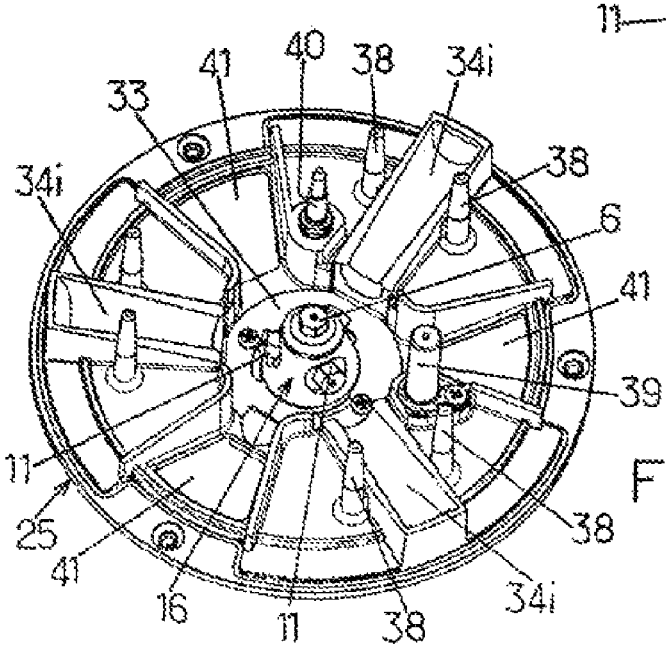
FIG. 7 illustrates a variant embodiment of the pot of the burner according to the invention shown in a similar representation to that of the pot appearing in FIG. 4, but with a different angular orientation.

A second embodiment consists, as illustrated in FIG. 7 (in which the same numerical references are retained for denoting elements or parts identical to those corresponding to FIG. 4), in that the pot 25 has a structure that is perforated in 41, at least partially, between the gutters 34*i*. This structure is adapted for ensuring the primary air supply of the two burners, the central burner 2 and the annular outer burner 3, from below the upper plate of the cooking appliance.

Independently of the design of the pot, as is better seen in FIGS. 2 and 4, the gutters 34*i* of the pot 25 extend as far as under the annular part of the head 27 and the annular part of the head 27 has its bottom 19 that is provided with the above mentioned openings 20 facing the ends situated radially toward the outside of said gutters 34*i* of the pot 25.

In order to mount the burners, the central area 33 of the pot 25 has, as may be seen in FIG. 2, a central opening 37 through which said base 16 supporting the injectors is engaged from underneath the pot 25, with its upper truncated conical part projecting above said central area 33 and with its lower part subjacent to the pot, said lower part being provided with said bore 17 adapted for receiving the end of a gas supply tube.

Figure 5:
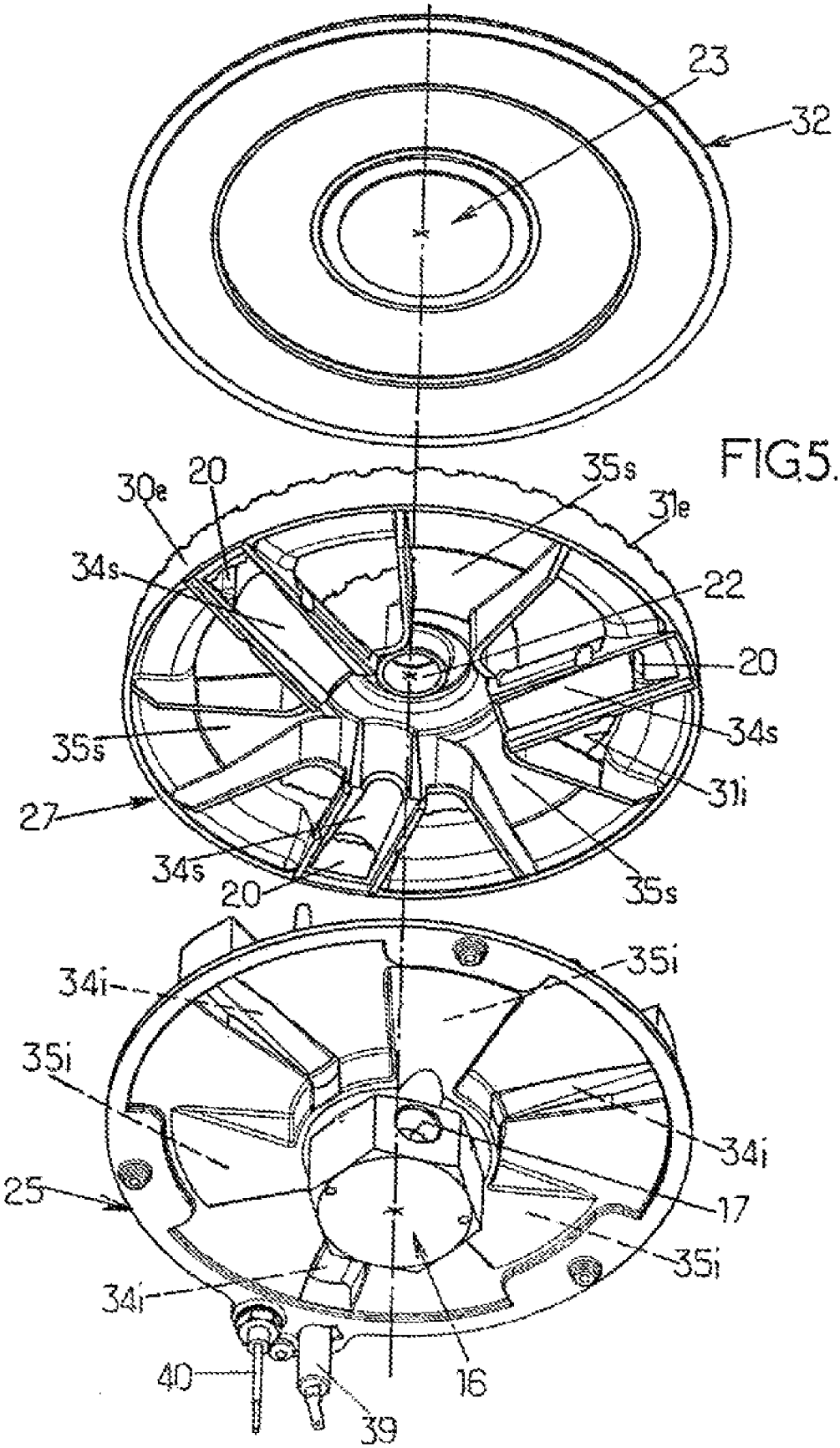
FIG. 5 is an exploded view in perspective from below of the burner of FIGS. 1 and 2.

In the concrete example of an embodiment illustrated in FIGS. 2, 4 and 5, the pot 25 and/or the head 27 have/has three substantially radial gutters, 34*i*, 34*s* respectively, mutually separated angularly by approximately 120°, and three substantially radial grooves, 35*i*, 35*s* respectively, interposed between said gutters.

As will be better seen in FIGS. 4 and 5, the implementation of the provisions that have just been described leads to a pot 25 with a solid structure, while the head 27 has a perforated structure, with the gutters 34*s* and grooves 35*s* constituting spokes mechanically connecting the central part to the annular part.

In order to ensure correct mutual angular positioning of the superimposed pot 25 and head 27, provision is made for means for guiding and locking in rotation that, in the example illustrated, comprise pairs of fingers 38 carried for example by the pot 25 and projecting vertically upward, while being positioned either side of the respective gutters 34*i*. When the head 27 is mounted, the gutters 34*s* are each interposed between two facing fingers 38. An inverse arrangement could of course be adopted, with the projecting fingers carried by the head either side of the gutters 34*s*.

It will be emphasized that an electrical ignition electrode 39 and/or a thermocouple 40 for detecting the presence of flames may, if desired, be installed in the burner 1, in any suitable location thereof. As an example, the ignition electrode 39 and the thermocouple 40 are shown in the outer edge of the pot 25 in FIG. 5, while they are shown in a central position in the pot 25 and in different locations from that in FIGS. 2 and 4.

Figure 6B:
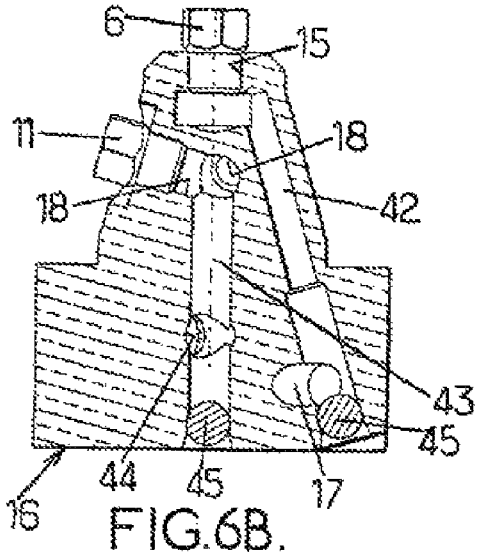
Figure 6C:
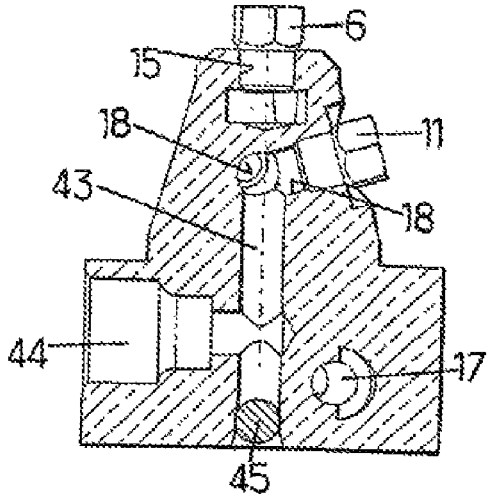
Figure 6A:
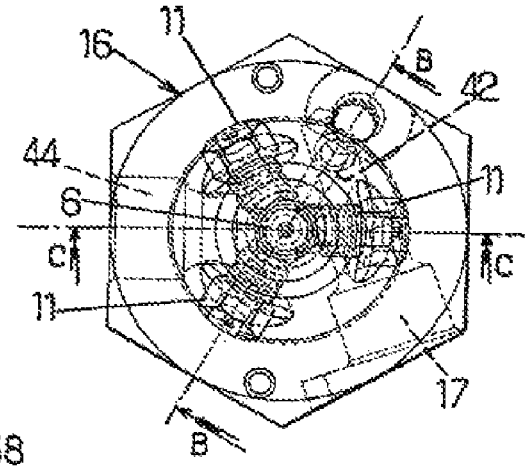

If it is desired to have two distinct supplies available for the central burner 2 and annular outer burner 3 respectively, provision is made, as shown in FIGS. 6A to 6C, for the base 16 to have a first connecting bore 17 communicating with the central bore 15 and adapted for receiving the end of a first gas supply tube (not shown) and a second connecting bore 44 communicating with said lateral bores 18 and adapted for receiving the end of a second gas supply tube (not shown).

In the design of the base 16 illustrated by way of example in FIGS. 6A to 6C, provision is made, as will be better seen in FIG. 6B, for the axial central bore 15 receiving the axial central injector 6 of the central burner 2 to be connected by a channel 42 offset laterally to the connecting bore 17 which, here, is situated laterally at the bottom of the base 16 and is not radially extended.

For their part, the bores 18 of the radial injectors 11 of the annular outer burner 3 are connected by a channel 43 situated axially to a second connecting bore 44 which here also is situated laterally at the bottom of the base 16 and is extended substantially radially.

Thus arranged, the base 16 is a relatively complex part with many emerging perforations of which some should then be closed (stoppers 45) so as to constitute suitable channels.

What is claimed is:

1. A gas burner with multiple concentric flame rings, comprising:

a central burner with a central ring of flame orifices, an axial central gas injector for said central burner, and convergent-divergent means forming venturi interposed between the central injector and the central ring of flame orifices, and an annular outer burner coaxially surrounding said central burner and provided with at least one annular ring of flame orifices, gas injecting means for the annular outer burner, that comprise several gas injectors positioned substantially radially around the axial central gas injector, and convergent-divergent means that form venturis interposed between the gas injecting means and the annular ring of flame orifices and that comprise at least two substantially radial convergent-divergent conduits forming tubular venturis with respective substantially radial spans and opening in the annular outer burner, said convergent-divergent conduits extending substantially coaxially respectively to said radial injectors, and means for supplying gas to said axial central injector and to said gas injecting means, wherein said gas burner has a central base fixed coaxially to the central burner on a lower constituent part of the burner or pot, wherein said central base comprises:

a substantially coaxial central bore emerging upward and adapted for receiving said axial central gas injector, and at least two substantially radial lateral bores emerging laterally while being adapted for receiving respectively the at least two lateral gas injectors positioned substantially radially the gas burner further comprising:

a lower constituent part or pot adapted for being fixed to an upper plate of a cooking appliance substantially coaxial to an opening of said upper plate, an upper constituent part or head comprising a central part delimited peripherally by a lateral wall curved so as to constitute said central ring of flame orifices and an annular part substantially coaxial with said central part and delimited by at least one lateral wall curved so as to constitute said annular ring of flame orifices, a central cap with a substantially discoid shape adapted for covering said central part, and an annular cap adapted for covering said annular part, wherein the pot has a central area arranged so as to support the axial injector and the radial injectors centrally, and at least the pot and/or the head have/has at least two radiating gutters that extend from said central area or respectively said central part where they emerge and as far as the outer edge of the pot or respectively as far as the annular part with which they communicate, said gutters being closed by the head or pot respectively in the assembly position of said pot and head so as to constitute said convergent-divergent conduits forming tubular venturis with a substantially radial span, wherein the pot has a solid structure and in that at least the pot and/or the head have/has at least two substantially radial grooves, interposed between said gutters, which extend while emerging between said central area and the outer edge of the pot or head respectively, these grooves being closed by the head or pot respectively in the assembly position of said pot and head in order to constitute passages with a generally radial span adapted for ensuring the supply of primary air from above the upper plate of the cooking appliance, and wherein:

the pot has at least two substantially radial grooves, that are interposed between said gutters and that open substantially upward, the head has at least two substantially radial grooves, that are interposed between said gutters and that open substantially downward, and the grooves of the pot and the grooves of the head are superimposed pairwise in the assembly position of said pot and head, so as to constitute said passages for supplying primary air.

2. A gas burner with multiple concentric flame rings, comprising:

a central burner with a central ring of flame orifices, an axial central gas injector for said central burner, and convergent-divergent means forming venturi interposed between the central injector and the central ring of flame orifices, and an annular outer burner coaxially surrounding said central burner and provided with at least one annular ring of flame orifices, gas injecting means for the annular outer burner, that comprise several gas injectors positioned substantially radially around the axial central gas injector, and convergent-divergent means that form venturis interposed between the gas injecting means and the annular ring of flame orifices and that comprise at least two substantially radial convergent-divergent conduits forming tubular venturis with respective substantially radial spans and opening in the annular outer burner, said convergent-divergent conduits extending substantially coaxially respectively to said radial injectors, and means for supplying gas to said axial central injector and to said gas injecting means, wherein said gas burner has a central base fixed coaxially to the central burner on a lower constituent part of the burner or pot, and wherein said central base comprises:

a substantially coaxial central bore emerging upward and adapted for receiving said axial central gas injector, and at least two substantially radial lateral bores emerging laterally while being adapted for receiving respectively the at least two lateral gas injectors positioned substantially radially, the gas burner further comprising:

a lower constituent part or pot adapted for being fixed to an upper plate of a cooking appliance substantially coaxial to an opening of said upper plate, an upper constituent part or head comprising a central part delimited peripherally by a lateral wall curved so as to constitute said central ring of flame orifices and an annular part substantially coaxial with said central part and delimited by at least one lateral wall curved so as to constitute said annular ring of flame orifices, a central cap with a substantially discoid shape adapted for covering said central part, and an annular cap adapted for covering said annular part, wherein the pot has a central area arranged so as to support the axial injector and the radial injectors centrally, and at least the pot and/or the head have/has at least two radiating gutters that extend from said central area or respectively said central part where they emerge and as far as the outer edge of the pot or respectively as far as the annular part with which they communicate, said gutters being closed by the head or pot respectively in the assembly position of said pot and head so as to constitute said convergent-divergent conduits forming tubular venturis with a substantially radial span, wherein the pot and/or the head have/has pairs of projecting fingers positioned either side of the respective gutters and adapted for receiving the corresponding gutters of the head and/or the pot respectively.

* * * * *